US007223078B1

(12) United States Patent
Mares et al.

(10) Patent No.: US 7,223,078 B1
(45) Date of Patent: May 29, 2007

(54) ROTARY PLATE FASTENER FOR CEILING FAN BLADES

(75) Inventors: John F. Mares, Coppell, TX (US); Richard H. Crawford, Jr., Austin, TX (US); Jason T. Herlehy, Austin, TX (US); Bradley A. Jackson, Austin, TX (US)

(73) Assignee: Litex Industries, Limited, Having a general partner of Libco International, LLC, Grand Prairie, TX (US)

( * ) Notice: Subject to any disclaimer, the term of this patent is extended or adjusted under 35 U.S.C. 154(b) by 367 days.

(21) Appl. No.: 11/039,143

(22) Filed: Jan. 19, 2005

Related U.S. Application Data

(60) Provisional application No. 60/629,064, filed on Nov. 18, 2004.

(51) Int. Cl.
*F01D 5/30* (2006.01)

(52) U.S. Cl. ..... 416/210 R; 416/214 R

(58) Field of Classification Search ..... 416/204 R, 416/207, 210 R, 214 R, 220 R, 244 R; 464/70, 464/71

See application file for complete search history.

(56) References Cited

U.S. PATENT DOCUMENTS

| | | | | |
|---|---|---|---|---|
| 2,581,872 | A | 1/1952 | Morrison | |
| 3,628,888 | A | 12/1971 | Wooden | |
| 3,930,332 | A | 1/1976 | Seefluth | |
| 4,511,310 | A | 4/1985 | Pearce | |
| 4,826,405 | A | 5/1989 | Robb | |
| 5,501,010 | A | 3/1996 | Scott | |
| 5,593,283 | A | 1/1997 | Scott | |
| 5,944,487 | A * | 8/1999 | Pearce | 416/244 R |
| 6,039,540 | A | 3/2000 | Wu | |
| 6,042,339 | A | 3/2000 | Blateri et al. | |
| 6,171,060 | B1 * | 1/2001 | Gajewski | 416/244 R |
| 6,241,475 | B1 | 6/2001 | Blateri et al. | |
| 6,241,476 | B1 | 6/2001 | Lee | |
| 6,336,792 | B1 | 1/2002 | Bucher et al. | |
| 6,371,729 | B1 | 4/2002 | Tseng | |
| 6,508,629 | B2 | 1/2003 | Kerr, Jr. | |
| 6,652,236 | B2 | 11/2003 | Hai | |
| 6,758,626 | B1 | 7/2004 | Tseng | |
| 6,802,694 | B2 | 10/2004 | Bucher et al. | |
| 6,821,091 | B2 | 11/2004 | Lee | |
| 6,902,375 | B2 * | 6/2005 | Bird et al. | 416/207 |
| 6,935,842 | B2 * | 8/2005 | Tai | 416/210 R |

* cited by examiner

*Primary Examiner*—Edward K. Look
*Assistant Examiner*—Devin Hanan
(74) *Attorney, Agent, or Firm*—Mark W. Handley

(57) ABSTRACT

A rotary plate fastener (24) is provided for firmly fastening ceiling fan blades (26) to mounting brackets (20). A plurality of protuberant members (32) extend upwardly from the mounting brackets (20), and have respective head portions (72) and shank portions (74) which fit through apertures (62) in the ceiling fan blades (26). The rotary plate fastener (24) has an upper surface (36), a lower surface (38), and peripheral edge portions (42) extending between the upper and lower surfaces (36, 38). Openings (46) formed in the peripheral edge portions (42) are aligned for registering adjacent to the shank portions (74) of the protuberant members (32), and then the rotary plate fastener (24) is rotated to twist the openings (46) around the shank portions (74) and press the rotary plate fastener (24) between the head portions (72) of the protuberant members (32) and the upper surface of ceiling fan blade (26).

20 Claims, 6 Drawing Sheets

ROTARY PLATE FASTENER FOR CEILING FAN BLADES

CROSS-REFERENCE TO RELATED APPLICATION

The present application claims priority to related U.S. Provisional Patent Application Ser. No. 60/629,064, entitled "Rotary Plate Fastener for Ceiling Fan Blades," filed Nov. 18, 2004, invented by John F. Mares, and assigned to Litex Industries, Limited, a Limited Partnership under the laws of the State of Texas, having a general partner of Libco International, L.L.C., a limited liability company under the laws of the State of Texas.

TECHNICAL FIELD OF THE INVENTION

The present invention relates in general to ceiling fans, and in particular to fasteners for firmly fastening fan blades to mounting brackets of ceiling fan rotors.

BACKGROUND OF THE INVENTION

Prior art quick-connect fasteners for firmly fastening fan blades to mounting brackets connected to rotors of ceiling fan motors have been disclosed in U.S. Pat. No. 6,241,476, U.S. Pat. No. 6,336,792, U.S. Pat. No. 6,821,091, and U.S. Pat. No. 6,802,694. One of these prior art patents discloses that the ceiling fan blade being fastened be moved lineally away from the ceiling fan blade to engage a spring clip lock member against an edge of the ceiling fan blade to latch the blade to a motor mounting bracket. Others of the prior art patent disclosures have fastening means which require that a fastening clip or a fastening plate be moved lineally away from the ceiling fan blade to firmly fasten the blade to one of the motor mounting brackets. Each requires that lineal force be applied in a direction away from the ceiling fan motor, which requires the application of an opposite force to prevent movement of the ceiling fan to which the blade is being mounted. This requires a person, or persons, mounting the blades to a ceiling fan to apply opposing forces when often disposed in awkward positions, such as standing at an elevated position on a stool or a ladder, and at times reaching outward to grasp both the fan blade and either the fastening clip, fastening plate or other parts of a mounting bracket.

SUMMARY OF THE INVENTION

A novel rotary plate fastener is disclosed for providing a quick connect fastener which firmly fastening fan blades to ceiling fan motor mounting brackets. A plurality of protuberant members extend upwards from each of the mounting brackets. The protuberant members have shank portions and head portions which fit through apertures in the ceiling fan blades. The rotary plate fastener has a body with an upper surface, a substantially planar lower surface, and peripheral edge portions extending between the upper and lower surfaces. The peripheral edge portions include openings which are preferably C-shaped, with the openings extending into the body of the rotary plate fastener. The openings are aligned for registering adjacent to the protuberant members which extend upward from one of the mounting brackets and through a ceiling fan blade, and then rotating the rotary plate fastener to twist the openings around the shank portions of the protuberant members which extend above the upper surface of the ceiling fan blade being fastened, such that the rotary plate fastener is pressed between the head portions of the protuberant members and the upper surface of ceiling fan blade.

DESCRIPTION OF THE DRAWINGS

For a more complete understanding of the present invention and the advantages thereof, reference is now made to the following description taken in conjunction with the accompanying Drawings in which

FIG. 1 is a partial perspective view of a ceiling fan having fan blades mounted to a ceiling fan motor with mounting brackets and having a rotary plate fastener firmly securing the fan blades to respective ones of the mounting brackets;

FIG. 2 is partial perspective view of one of the ceiling fan blades firmly fastened to a mounting bracket arm by means of one of the rotary plate fasteners;

FIG. 3 is an exploded view of the mounting bracket arm, protuberant members which extend from the mounting bracket arm, an inward end portion of the fan blade and the rotary plate fastener;

FIG. 4 is a perspective view of the rotary plate fastener;

FIG. 5 is a top view of the rotary plate fastener;

FIG. 6 is a side view of the rotary plate fastener;

FIG. 7 is bottom view of the rotary plate fastener;

FIG. 8 is a partial, section view of the rotary plate fastener, taken along Section Line 8—8 of FIG. 5;

FIG. 9 is a partial, section view of the rotary plate fastener, taken along Section Line 9—9 of FIG. 5;

FIG. 10 is sectional view of the fan blade, the mounting bracket arm, a threaded fastener, a bushing and the rotary plate fastener, taken along Section Line 10—10-of FIG. 2;

FIG. 11 is an exploded, sectional view of the fan blade, the mounting bracket arm, the threaded fastener and the rotary plate fastener, taken along Section Line 10—10 of FIG. 2;

FIG. 12 is a perspective view of an alternative rotary plate fastener;

FIG. 13 is a bottom view of the alternative rotary plate fastener;

FIG. 14 is an exploded view of a mounting bracket arm, an inward portion of a ceiling fan blade, and the alternative rotary plate fastener;

FIG. 15 is a top view of a second alternative rotary plate fastener;

FIG. 16 is a partial, section view of the second alternative rotary plate fastener, taken along Section Line 16—16 of FIG. 15;

FIG. 17 is a partial, section view of the second alternative rotary plate fastener, taken along Section Line 17—17 of FIG. 15; and FIG. 18 is a partial, top view of the second alternative rotary plate fastener.

DETAILED DESCRIPTION OF THE INVENTION

Figure 1:
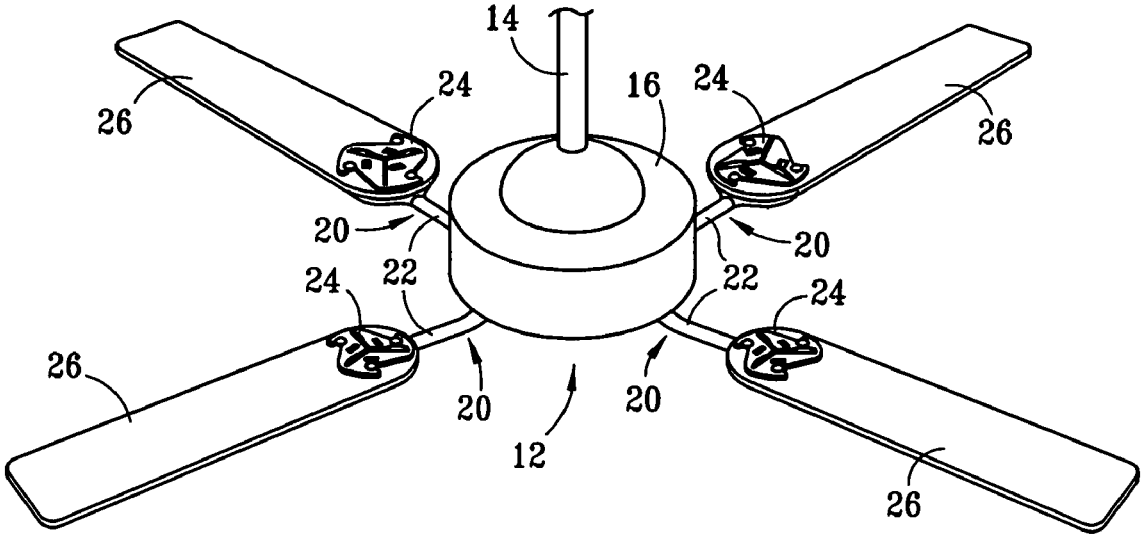
FIGS. 1 through 18 show various aspects for a rotary plate fastener for quickly mounting ceiling fan blades to ceiling fan mounting brackets according to the present invention, as set forth below.

Referring to the Figures, FIG. 1 is a perspective view of a ceiling fan 12 having a down rod 14, a motor housing 16 and fan blades 26. Mounting brackets 20 are mounted to a motor of the ceiling fan 12 and include mounting arms 22. The fan blades 26 are firmly fastened to the mounting brackets 20 by rotary plate fasteners 24.

Figure 2:
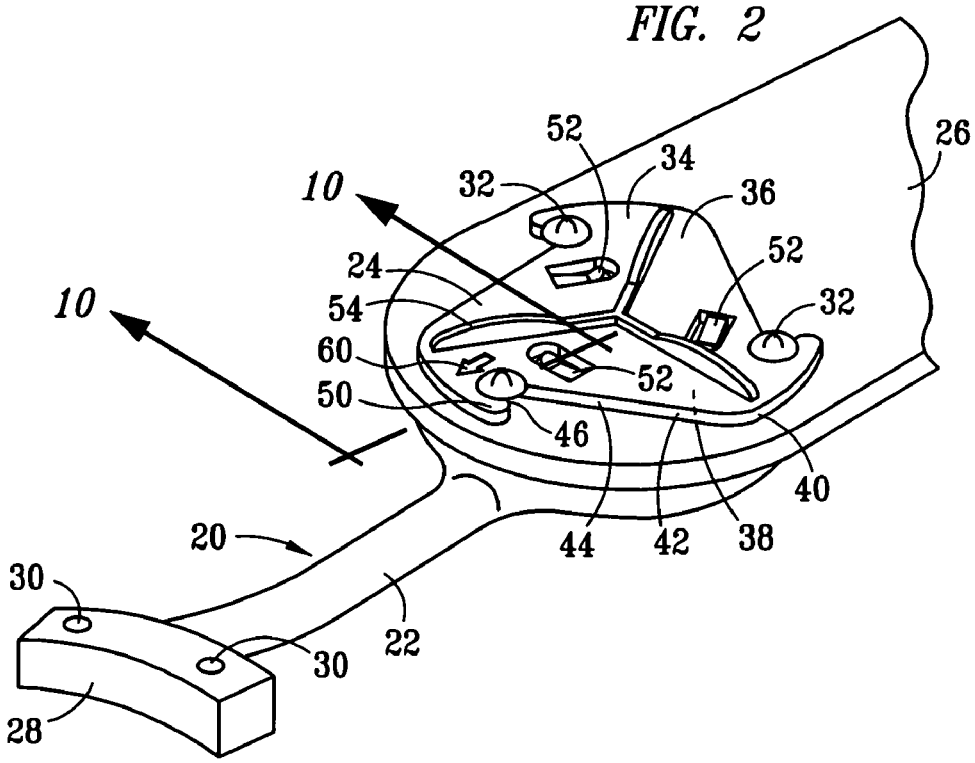

FIG. 2 is partial perspective view of one of the ceiling fan blades 26 fastened to the mounting bracket arm 22 by means of the rotary plate fastener 24. The mounting bracket arm 22 includes an arcuately shaped connector plate 28 having mounting holes 30 for firmly fastening the connector plate 28 to the motor of the ceiling fan 12. Protuberant members 32 extend upwards from the mounting bracket arm 22, through the fan blade 26, and protrude from the fan blade 26. The rotary plate fastener 24 has a body 34 which includes an upper surface 36, a lower surface 38 and a continuous peripheral edge 40. The continuous peripheral edge 40 is disposed between peripheral edges of the upper surface 36 and the lower surface 38, and includes peripheral edge portions 42 having guide surfaces 44 and openings 46. The peripheral edge 40 is preferably continuous, such that the edge 40 extends completely around the body 34 of the rotary plate fastener 24. The openings 46 are preferably C-shaped and extend a minimum of one-hundred and eighty degrees around the protuberant members 32 when firmly fastening fan blades 26 to the mounting bracket 20. In the preferred embodiment, the openings 46 extend approximately two-hundred degrees around the protuberant members 32 when firmly fastening fan blades 26 to the mounting bracket 20. Each of the openings 46 has one side which is closed, being defined by the exteriorly disposed peripheral edge 40 of the rotary plate fastener 24, and an opposite side of the openings 46 which is open to the exterior of the rotary plate fastener 24. The body 34 of the rotary plate fastener 24 preferably has outer portions 50 which extend outward of respective ones of the openings 46.

The rotary plate fastener 24 further has three grip tabs 54 which extend upward from the upper surface 36, and are preferably defined by radially extending ribs, or fins. The tabs 54 extends radially outward from a central portion of the body 34 to an edge portion of the upper surface 36 which is adjacent to the peripheral edge 40 of the rotary plate fastener 24. Compression members 52, or friction detents, are provided by spring-type tabs which extends downward within openings in central portions of the body 34 of the rotary plate fastener 24. The compression members 52 are friction detent tabs which provide elongated finger-like members for engaging an upper surface of the fan blade 26 to provide an outward force for enhancing the frictional engagement between the rotary plate fastener 24, and the fan blade 26 and the protuberant members 32. Preferably, the protuberances 32 of the mounting bracket arm 22 and the openings 46 of the rotary plate fastener 24 are arranged in a symmetrical pattern, but in some embodiments the protuberances 32 and the openings 46 are not symmetrical. When the protuberances 32 and the openings 46 are not arranged in a symmetrical pattern, a direction arrow 60 is preferably provided by an indentation on the upper surface 36 of the rotary plate fastener 24 to indicate a direction toward the mounting arm 22 to align the direction arrow 60 for aligning the openings 46 of the rotary plate faster 24 for mating with the protuberances 32.

Figure 3:
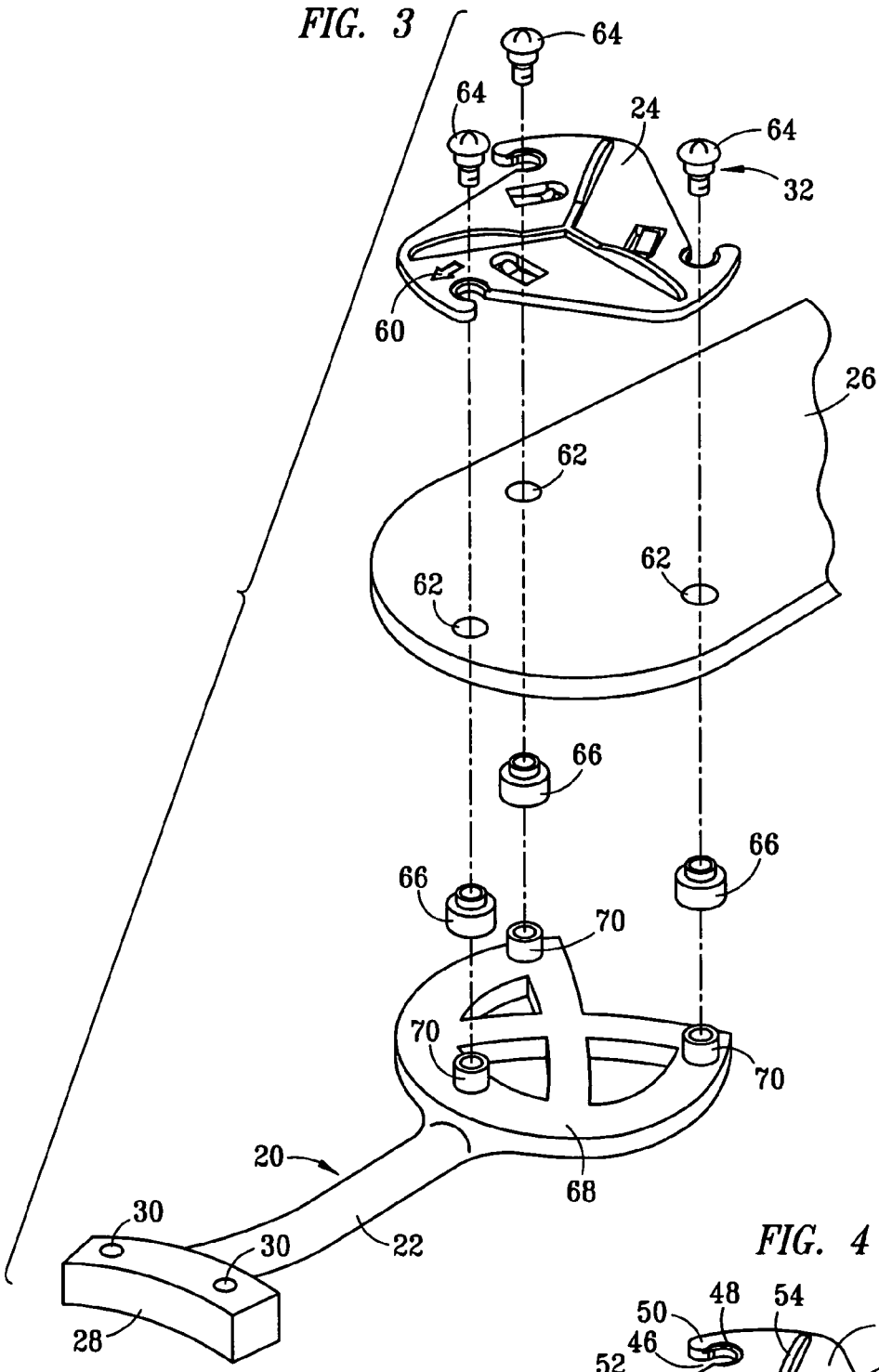

FIG. 3 is an exploded view of the mounting bracket arm 22 and an inward end portion of the fan blade 26. The fan blade 26 has apertures 62 for passing the protuberant members 32, which preferably extend upward from the mounting bracket arm 22. The mounting bracket arm 22 has a mounting portion 68, or enlarged body portion, which provides a support member against which one side of the fan blade 26 is mounted. Three bosses 70 are preferably integrally formed with the mounting portion 68 and extend upward therefrom in a spaced apart in alignment for registering with the apertures 62 in the fan blade 26. The protuberant members 32 are preferably provided by a threaded fastener 64 and a resilient bushing 66. The threaded fasteners 64 are sized for fitting through the apertures 62 in the fan blade 25, and the resilient bushings 66 are preferably sized for fitting snugly within the apertures 62. Outer ends of the threaded fastener 64 and the bushing 66 will protrude outward of the apertures 62. Portions of the upper surface 36 of the rotary plate fastener 24 which are disposed adjacent to the openings 46 are countersunk, to provide recesses 48 for receiving and engaging against the threaded fasteners 64.

Figure 4:
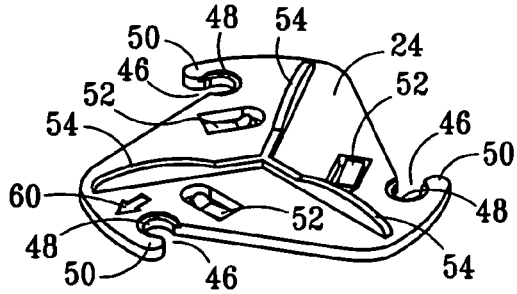
Figure 5:
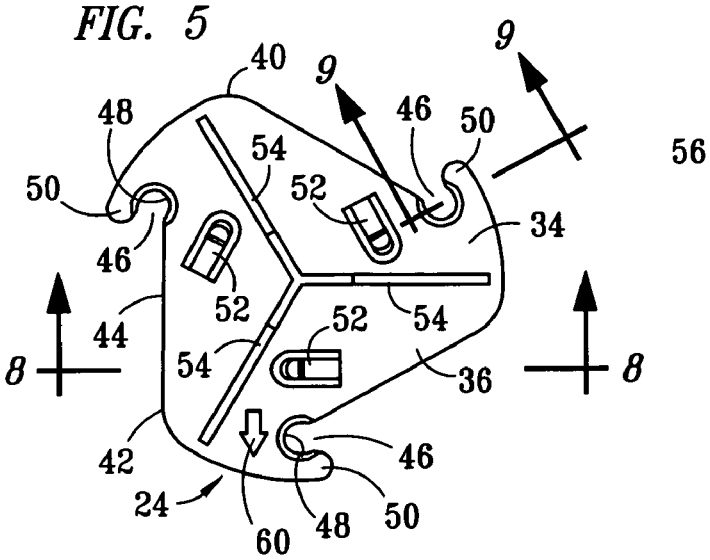
Figure 6:
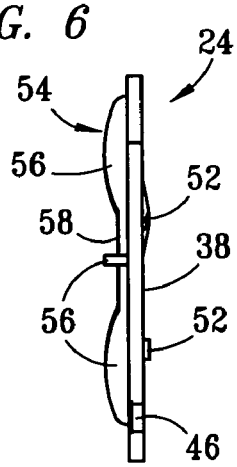
Figure 7:
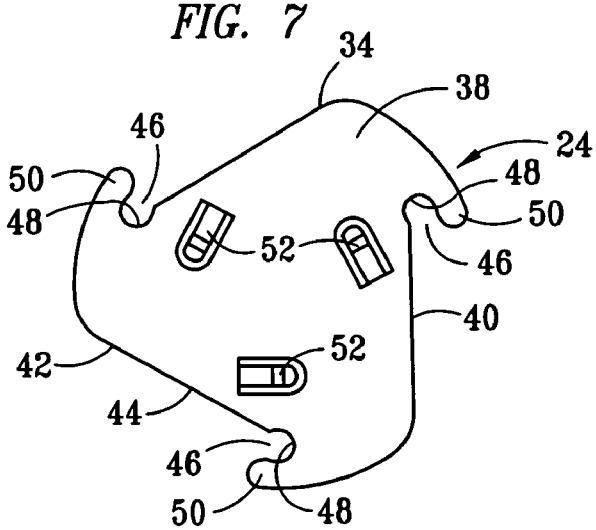
Figure 8:
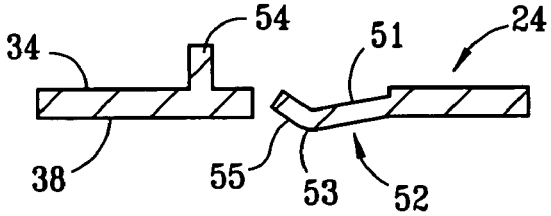
Figure 9:
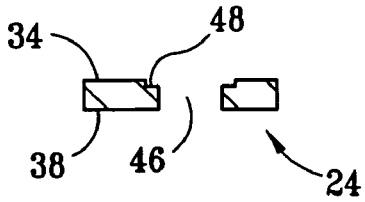

FIGS. 4 through 9 are various views of the rotary plate fastener 24, showing various features thereof. FIG. 4 is a perspective view, FIG. 5 is a top view, FIG. 6 is a side view, and FIG. 7 is bottom view of the rotary plate fastener 24. FIG. 8 is a partial, section view of the rotary plate fastener 24, taken along Section Line 8—8 of FIG. 5, and shows the compression members 52 in more detail. The compression member 52 are preferably each provided by elongate tabs having a first portion 51 which extends downward to an intermediate engagement portion 53, and then outward to a terminal end 55. The intermediate portion 53 engages against the upper surfaces of one of the fan blades 26, and the first portion 51 is pressed inward toward the body 24 of the rotary plate fastener 24 to provide spring forces which push the rotary plate fastener 24 away from the fan blade 26 and the protuberant members 32. FIG. 9 is a partial, section view of the rotary plate fastener 24, taken along Section Line 9—9 of FIG. 5, and shows the C-shaped openings 46 and the recesses 48 in the body 34 of the rotary plate fastener 24 in more detail.

Figure 10:
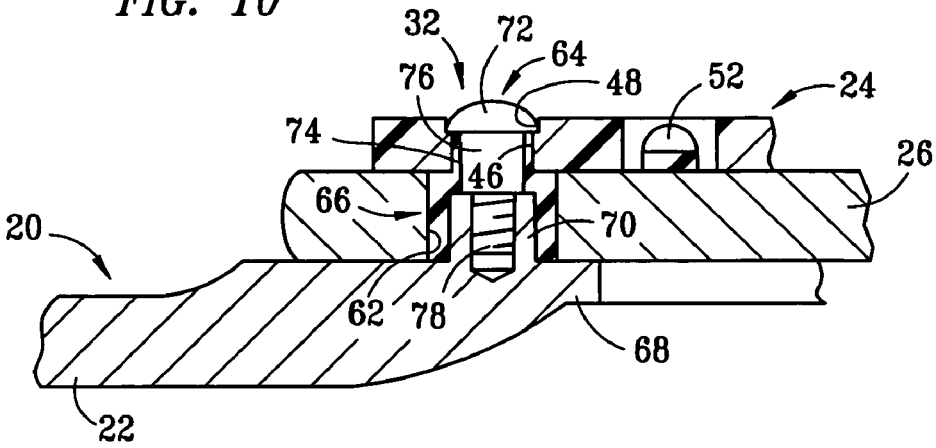

FIG. 10 is a partial section view of the fan blade 26, the mounting bracket arm 22 and the rotary plate fastener 24, taken along Section Line 10—10 of FIG. 2. The protuberant member 32 is shown as being provided by the threaded fastener 64 and the resilient bushing 66. The threaded fastener 64 has a head 72, which provides a head portion, and a shank 74, which provides a shank portion. The bushing 66 fits over the boss 70 of the mounting portion 68 of the mounting arm 22. The shank 74 of the threaded fastener 64 extends through the bushing 66 and is threadingly secured to the boss 70. The head 72 of the threaded fastener 64 fits within the recess 48 above the C-shaped opening 46. The head 72 is spaced apart above the upper surface of the fan blade 26 to provide an interference fit between the head 72 and the upper surface of the fan blade 26, and the thickness of the rotary plate fastener 24 at the recess 48. The compression member 52 of the rotary plate fastener 24 is pressing against the upper surface of the fan blade 26, and increases the frictional engagement between the fan blade 26 and the rotary plate fastener 24 in two ways. First, the compression member 52 presses the rotary plate fastener 24 against the head 72 of the threaded fastener 64, at the recess 48, to enhance both the interference fit of the thickness of the rotary plate fastener fitting between the head 72 of the threaded fastener 64 and the upper surface of the ceiling fan blade 26. Second, the compression member 52 presses against the surface of the fan blade 26 with greater force than if only a planar portion of the bottom 38 of the rotary place member is disposed adjacent to the fan blade 26.

Figure 11:
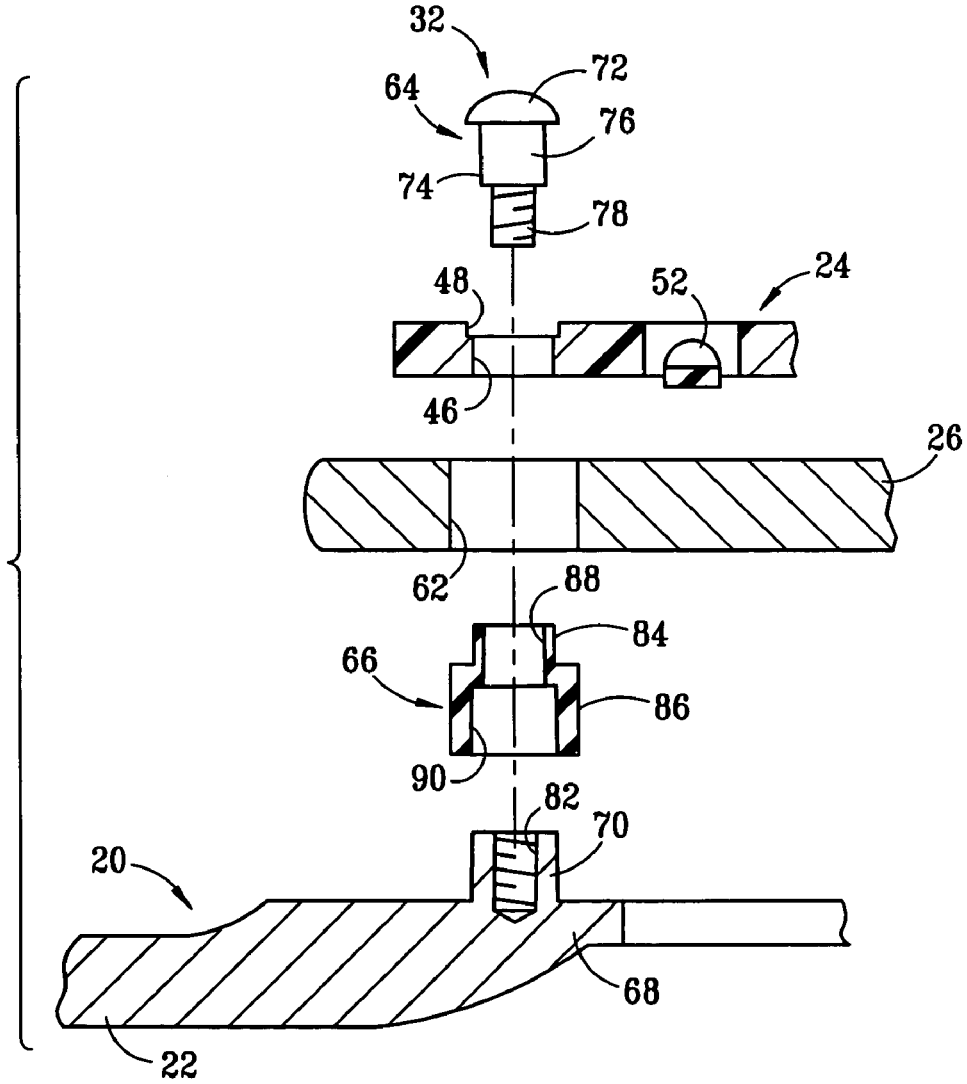

FIG. 11 is a partial, exploded, side elevation view of the fan blade 26, the mounting bracket arm 22, the threaded fastener 64, the bushing 66 and the rotary plate fastener 24. The shank 74 of the threaded fastener 64 preferably has an enlarged upper portion 76 and a threaded lower end portion 78. The boss 70 is formed on mounting portion 68 of the mounting bracket arm 22 with a threaded bore 82 for threadingly securing the threaded end portion 78 of the threaded fastener 64 thereto. The resilient bushing 66 is preferably formed of an elastomeric material, but may also be formed of non-resilient materials. In some embodiments, the protuberant member 32 may be provided without the bushing 66. The resilient bushing 66 includes a smaller outer diameter portion 84 for snugly fitting within the openings 46 in the rotary plate fastener 24, and an enlarged outer diameter portion 86 for snugly fitting within the apertures 62 of the fan blade 26. The snug fit is provided by either an interference fit or a slight clearance between the bushing 66 and respective ones of the rotary plate fastener 24 and the fan blade 26. The bushing 66 further includes a larger inner diameter 90 for receiving the boss 70, and a smaller inner diameter 84 for receiving the upper portion 76 of the shank 74 with the head 72 of the threaded fastener disposed above, and preferably adjacent to, the upper terminal end of the bushing 66.

Figure 12:
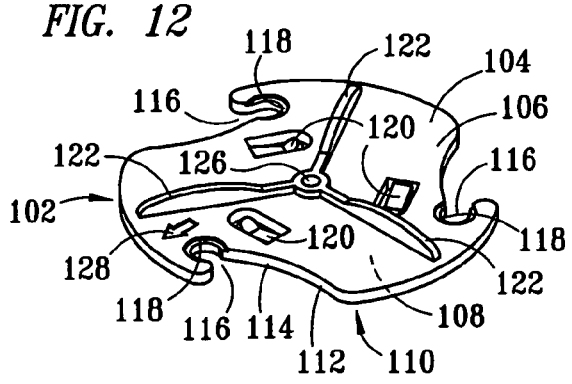
Figure 13:
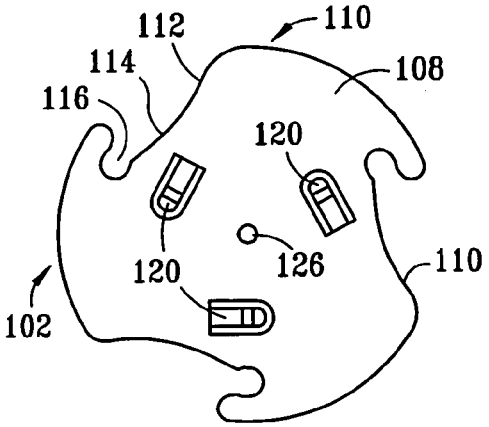

FIG. 12 is a perspective view and FIG. 13 is a bottom view of an alternative rotary plate fastener 102. The rotary plate fastener 102 has a body 104, with an upper surface 106, a lower surface 108, and a continuous peripheral edge 110 disposed between the periphery of the upper surface 106 and the periphery of the lower surface 108. The peripheral edge 110 is continuous, since it extends completely around the body 104, adjacent the peripheries of the upper surface 106 and the lower surface 108. The peripheral edge 110 includes edge portions 112 having guide portions 114, and C-shaped openings 116. Portions of the upper surface 106 of the body 104 of the rotary plate fastener 102 are preferably recessed adjacent to the openings 116 to provided recesses 118. The recesses 118 are preferably provided atop the openings 116, but may be omitted in other embodiments of rotary plate fasteners. The rotary plate fastener 102 further includes compression members 120, which are provided by elongate friction detent members, similar to the compression members 52 described above. Preferably, the openings 116 are symmetrically aligned, equal angular distances around a center of rotation of the rotary plate fastener 102. In other embodiments, in which the openings 116 are asymmetrically aligned, at unequal angular distances around a center of rotation of the rotary plate fastener 102, a guide arrow 128 may be provided. The guide arrow 128 is for aligning the rotary plate fastener 102 with the mounting bracket arm 136 when the openings 116 are asymmetrically aligned, and will point toward the mounting bracket arm 136 when the openings 116 are aligned for receiving the protuberances of the mounting bracket arm 136. The rotary plate fastener 102 preferably has three grip tabs 122, a boss 124 and a guide aperture 126 for receiving a rotation post 142 (shown in FIG. 14). The guide aperture 126 is provided for receiving the rotation post 142, to align the rotary plate fastener 102 such that the openings 116 are located adjacent the protuberant members defined by the threaded fasteners 64 and the elastomeric bushings 66.

Figure 14:
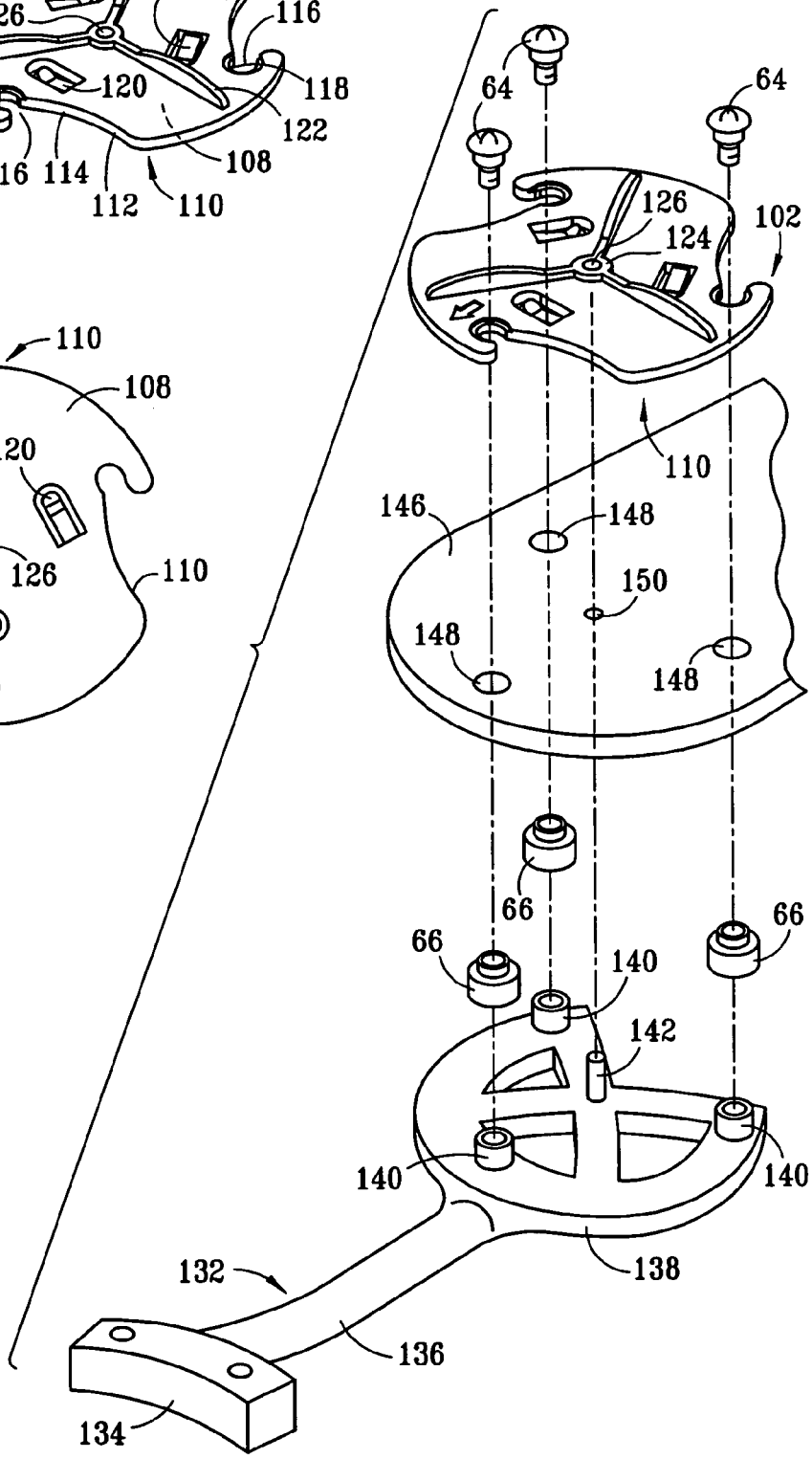

FIG. 14 is an exploded view of an alternative mounting bracket arm 136, an inward portion of a ceiling fan blade 146, and the alternative rotary plate fastener 102. The alternative mounting bracket arm 136 has three bosses 140, which are similar to bosses 70 of the mounting bracket arm 22 of FIG. 3. The bosses 140 have threaded bores for threadingly securing the threaded fasteners 64 to the bracket arm 136. Apertures 148 are provided in the fan blade 146 for passing the threaded fasteners 64 and the elastomeric bushings 66. A rotation post 142 is preferably provided by a pin member which is mounted to extend upward from a central portion of the mounting portion 138 of the mounting arm 136. An inward portion of an alternative ceiling fan 146 blade has a central aperture 150 for passing the rotation post 142 through the ceiling fan blade 146. The rotation post 142 fits within the centrally disposed aperture 150 in the fan blade 146, and the hole 126 in the alternative rotary plate fastener 102, and provides a guide for aligning the rotary plate fastener 102 with the ceiling fan blade 146 and the protuberances of the mounting bracket arm 136 which extend outward of the apertures 148 in the fab blade 130.

Figure 15:
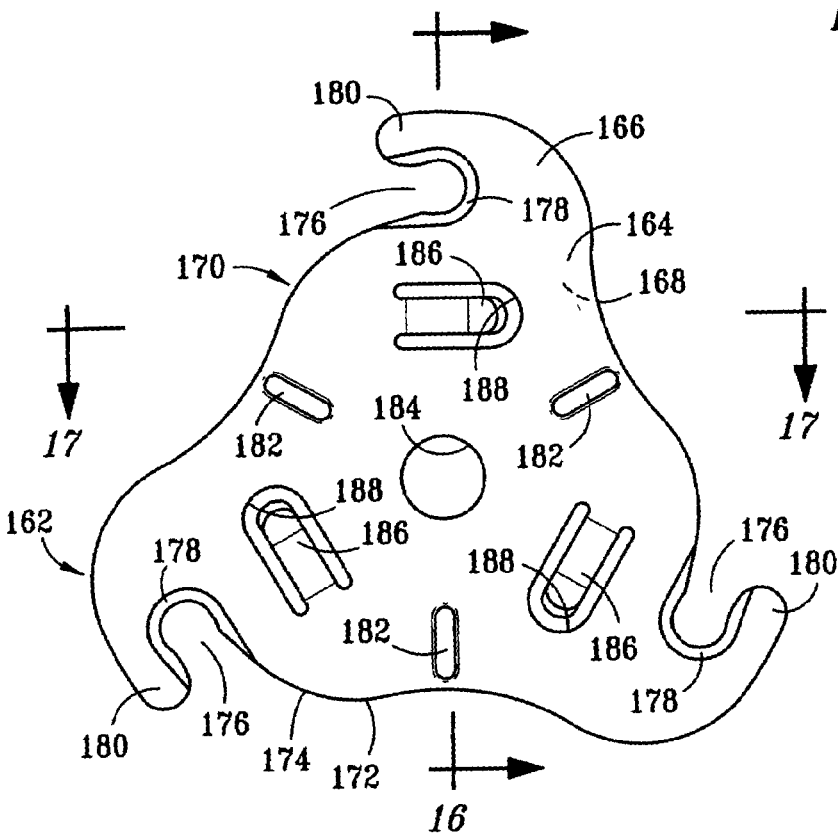

FIG. 15 is a top view of a second alternative rotary plate fastener 162. The second alternative rotary plate fastener 162 is preferably used in place of the rotary plate fastener 24 for firmly fastening the fan blades 26 to the mounting brackets 20 and the motor of the ceiling fan 12, as shown in FIGS. 1 through 3, 10 and 11 for the rotary plate fastener 24. The rotary plate fastener 162 has a body 164, with an upper surface 166, a lower surface 168, and a continuous peripheral edge 170 disposed between the periphery of the upper surface 166 and the periphery of the lower surface 168. The peripheral edge 170 is continuous, since it extends completely around the body 164, adjacent the peripheries of the upper surface 166 and the lower surface 168. The peripheral edge 170 includes edge portions 172 having guide portions 174 and edge openings 176. The edge openings 176 are preferably C-shaped and extend a minimum of one-hundred and eighty degrees around the protuberant members, such as the members 32 shown in FIG. 2, when firmly fastening fan blades 26 to the mounting bracket 20. Each of the openings 176 has one side which is closed, being defined by the exteriorly disposed peripheral edge 172 of the rotary plate fastener 162 and an opposite side of the edge openings 176 which are open to the exterior of the rotary plate fastener 162. The body 164 of the rotary plate fastener 162 preferably has outer portions 180 which extend outward of respective ones of the edge openings 172. Portions of the upper surface of the body 164 of the rotary plate fastener 162 are preferably recessed adjacent to the edge openings 176 to provided recesses 178. The recesses 178 are preferably provided atop the upper surface 166, adjacent to the openings 172, but may be omitted in other embodiments of rotary plate fasteners. The edge openings 176 and the recesses 178 are preferably similar to the edge openings 46 and the recesses 48 discussed above and shown in FIG. 9 in reference to the rotary plate fastener 24.

The edge openings 176 are preferably coplanar and spaced apart equal angular distances around a center of the body 164 for registering with protuberances of mounting bracket arms which are also spaced apart equal angular distances. The edge openings 176 are preferably located on a common circle extending around the center of rotation of the rotary plate fastener 162, facing the same angular direction relative to the center of rotation of the rotary plate fastener 162, which is preferably in a direction tangent to the center of rotation of the rotary plate fastener 162. In other embodiments, in which edge openings 176 and mounting bracket arm protuberances are not spaced apart equal angular distances, a direction arrow such as direction arrow 60 of FIG. 2 may be provided by an embossed arrow formed into the upper surface 166 of the rotary plate fastener 160, for pointing in the direction of a ceiling fan motor when the edge openings 176 are aligned for registering with asymmetrically spaced protuberances. In the preferred embodiment, the edge openings 176 extend approximately two-hundred degrees around the protuberant members when firmly fastening fan blades 26 to the mounting bracket 20.

Figure 16:
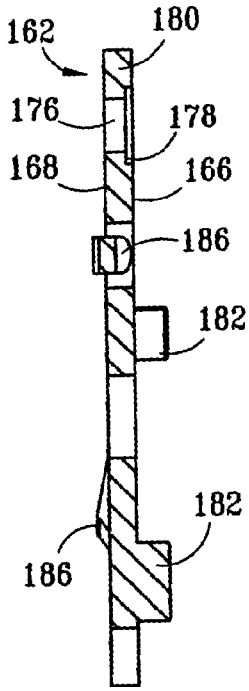
Figure 17:
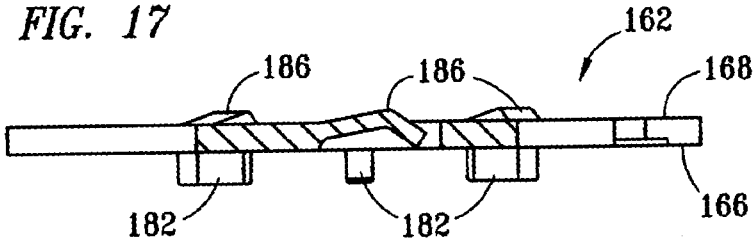

FIG. 16 is a partial, section view of the second alternative rotary plate fastener 162, taken along Section Line 16—16 of FIG. 15, and FIG. 17 is a partial, section view of the second alternative rotary plate fastener 162, taken along Section Line 17—17 of FIG. 15. The rotary plate fastener 162 preferably has three grip tabs 182, which are angularly spaced apart equal distances around a center portion of the body 164 to extend upward from the upper surface 166, each being angularly spaced apart midway between adjacent ones of the edge openings 176. The grip tabs 182 preferably do not extend adjacent to the peripheral edge 170, but are spaced apart a small distance from the peripheral edge 170. Additionally, the grip tabs 182 preferably do not extend fully to the central portion of the body 164 of the rotary plate fastener 162, being of a length which is less than half the distance between the peripheral edge 170 and an aperture 184. The aperture 184 is formed in the central portion of the body 164, extending through the upper surface 166 and the lower surface 168. The rotary plate fastener 162 further includes three compression members 186. The compression members 186 are provided by elongate friction detent members, similar to the compression members 52 described above and shown in FIG. 8 in reference to the rotary plate fastener 24. The three compression member 186 are disposed in openings 188, and are spaced apart equal angular distances around the aperture 184.

Figure 18:
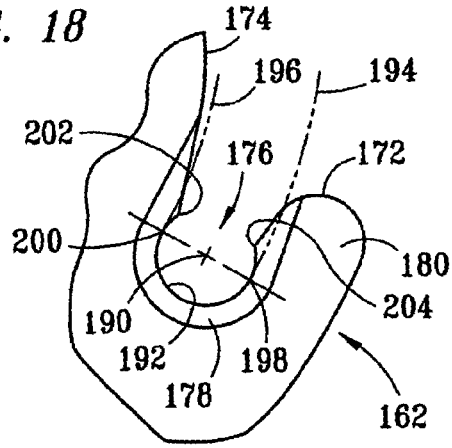

FIG. 18 is a partial, top view of the rotary plate fastener 162, showing more detail of the peripheral edge portion 172 which extends around the edge opening 176 according to a preferred embodiment of the present invention. The peripheral edge portion 172 at the edge opening 176 preferably has a semi-circular profile 192 which extends between points 198 and 200. The semicircular profile 192 preferably angularly extends one-hundred and eighty degrees around a centerline 190 of the profile 192. The arcuate projection lines 194 and 196 are shown extending from the points 198 and 200, respectively, tangent to the profile 192. The two projection lines 194 and 196 depict arcs which are rotated about a common axis with the center of rotation of the rotary plate fastener 162, such that one of the protuberances 32 (shown in FIG. 1) will follow a path between the two arcuate projection lines 194 and 196 when passing into and out of the edge opening 176. The peripheral edge portion 172 further preferably includes two protrusions 202 and 204 which extend from the upper surface 166 to the lower surface 168 of the rotary plate fastener 162 and provide an interference fit with shank portions of the protuberances 32, which are preferably provided by the smaller outer diameter portions 84 of the bushings 66. The interference fit between the protrusions 202 and 204 and the shank portions of the protuberances 32 provide a snap-fit when the protuberances 32 are fit within the edge openings 176.

It should be noted, that other embodiments of the rotary plate fasteners 24, 102 and 162 may in some embodiments not include the recesses 48, 118 and 178, and the compression members 52, 120 and 186, respectively.

The present invention provides a rotary plate connector for firmly fastening fan blades to mounting arms of ceiling fans using a twisting motion, rather than requiring lineal forces. The rotary plate connector has edge portions with C-shaped openings for receiving protuberant members extending from the mounting bracket arm, through apertures in the ceiling fan blades, and protruding outward of the ceiling fan blades. The protuberant members are preferably provided by threaded fasteners having respective shanks and heads. The protuberant member may also include a resilient bushing in some embodiments of the present invention.

Although the preferred embodiment has been described in detail, it should be understood that various changes, substitutions and alterations can be made therein without departing from the spirit and scope of the invention as defined by the appended claims.

What is claimed is:

1. An apparatus for firmly fastening a fan blade to a bracket arm mounted a ceiling fan motor, the fan blade having a plurality of mounting apertures extending transversely through an inward end of the fan blade, the apparatus comprising:

a plurality of protuberant members extending from the bracket arm, said protuberant members having shank portions and head portions which fit through the apertures in a the fan blade to extend outward of the fan blade on an opposite side of the fan blade from the bracket arm;

a rotary plate fastener having an upper surface, a lower surface and peripheral edge portions extending between said upper and lower surfaces, said peripheral edge portions having openings which are C-shaped and aligned for registering adjacent to said shank portions of said protuberant members extending through the fan blade; and wherein said rotary plate fastener is rotated to twist said openings around said shank portions of said protuberant members, such that said rotary plate fastener is pressed between said head portions of said protuberant members and a surface of the fan blade.

2. The apparatus according to claim 1, wherein said openings extend a minimum of one-hundred and eighty degrees around a circumference of said shank portions of said protuberant members.

3. The apparatus according to claim 1, wherein said rotary plate fastener further comprises tabs which extend from an opposite side of said rotary plate fastener from the fan blade, for pressing against to rotate said rotary plate fastener relative to the fan blade and said protuberant members.

4. The apparatus according to claim 3, wherein said tabs of said rotary plate fastener define ribs which extend on said opposite side of said rotary plate fastener from the fan blade.

5. The apparatus according to claim 1, wherein said rotary plate fastener further comprises compression members which are formed to extend from said rotary plate fastener and press against the fan blade.

6. The apparatus according to claim 5, wherein said compression members are formed in centrally disposed portions of said rotary plate fastener, and define spring fingers with outward portions for pressing against the fan blade.

7. The apparatus according to claim 1, wherein said openings in said peripheral edge portions of said rotary plate fastener have countersunk surfaces for receiving said head portions of said protuberant members.

8. The apparatus according to claim 1, wherein said openings have at least one protrusion at exterior portions thereof to provide a snap-fit when said protuberances are received within said openings.

9. The apparatus according to claim 1, wherein said protuberant members each comprise a threaded fastener and a bushing, said threaded fastener having a shank which extends through said bushing and a head which fits atop said bushing, and said bushing being formed of a resilient material having a first portion which fits snugly within one of said apertures of the fan blade and a second portion which fits snugly within one of said openings in said peripheral edge portions of said rotary plate fastener.

10. An apparatus for firmly fastening a fan blade to bracket arm of a ceiling fan motor, the fan blade having a plurality of mounting apertures extending transversely through an inward end of the fan blade, the apparatus comprising:

a plurality of protuberant members extending from the bracket arm, said protuberant members having shank portions and head portions which fit through the apertures in the blade to extend outward of the fan blade, on an opposite side of the fan blade from the bracket arm;

a rotary plate fastener having an upper surface, a lower surface and peripheral edge portions extending between said upper and lower surfaces, said peripheral edge portions having openings which are aligned for registering adjacent to said shank portions of said protuberant members extending through the fan blade;

wherein said openings are C-shaped and extend a minimum of one-hundred and eighty degrees around a circumference of said shank portions of said protuberant members;

said rotary plate fastener further having tabs which extend from an opposite side of said rotary plate fastener from the fan blade, for pressing against to rotate said rotary plate fastener relative to the fan blade and said protuberant members; and wherein said rotary plate fastener is rotated to twist said openings around said shank portions of said protuberant members, such that said rotary plate fastener is pressed between said head portions of said protuberant members and a surface of the fan blade.

11. The apparatus according to claim 10, wherein tabs of said rotary plate fastener define ribs which extend on said opposite side of said rotary plate fastener from the fan blade.

12. The apparatus according to claim 10, wherein said rotary plate fastener further comprises compression members which are formed to extend from said rotary plate fastener and press against the fan blade, said compression members are formed in centrally disposed portions of said rotary plate fastener, and define spring fingers with outward portions for pressing against the fan blade.

13. The apparatus according to claim 12, wherein said openings have at least one protrusion at exterior portions thereof to provide a snap-fit when said protuberances are received within said openings.

14. The apparatus according to claim 10, wherein said openings in said peripheral edge portions of said rotary plate fastener having countersunk surfaces for receiving said head portions of said protuberant members.

15. The apparatus according to claim 10, wherein said protuberant members each comprise a threaded fastener and a bushing, said threaded fastener having a shank which extends through said bushing and a head which fits atop said bushing, and said bushing being formed of a resilient material having a first portion which fits snugly within one of said apertures of the fan blade and a second portion which fits snugly within one of said openings in said peripheral edge portions of said rotary plate fastener.

16. An apparatus for firmly fastening a fan blade to bracket arm mounted to a ceiling fan motor, the fan blade having a plurality of mounting apertures extending transversely through an inward end of the fan blade, the apparatus comprising:

a plurality of protuberant members extending from the bracket arm, said protuberant members having shank portions and head portions which fit through the apertures in the fan blade to extend outward of the fan blade, on an opposite side of the fan blade from the bracket arm;

a rotary plate fastener having an upper surface, a lower surface and peripheral edge portions extending between said upper and lower surfaces, said peripheral edge portions having openings which are C-shaped and aligned for registering adjacent to said shank portions of said protuberant members extending through the fan blade;

wherein said openings extend a minimum of one-hundred and eighty degrees around a circumference of said shank portions of said protuberant members, with at least one surface of said rotary plate fastener disposed for engaging said head portions of said protuberant members when said protuberant members are disposed within respective ones of said openings;

wherein said protuberant members are defined by a threaded fastener and a bushing, said threaded fastener having a shank which extends through said bushing and a head which fits atop said bushing, and said bushing being formed of a resilient material having a first portion which fits snugly within one of said apertures of the fan blade and a second portion which fits snugly within one of said openings in said peripheral edge portions of said rotary plate fastener; and wherein said rotary plate fastener is rotated to twist said openings around said shank portions of said protuberant members, such that said rotary plate fastener is pressed between said head portions of said protuberant members and a surface of the fan blade.

17. The apparatus according to claim 16, wherein said openings in said peripheral edge portions of said rotary plate fastener have countersunk surfaces for receiving said head portions of said protuberant members.

18. The apparatus according to claim 16, further comprising said rotary plate fastener further having tabs which extend from an opposite side of said rotary plate fastener from the fan blade, for pressing against to rotate said rotary plate fastener relative to the fan blade and said protuberant members.

19. The apparatus according to claim 18, wherein said openings have at least one protrusion at exterior portions thereof to provide a snap-fit when said protuberances are received within said openings.

20. The apparatus according to claim 19, further comprising compression members formed in centrally disposed portions of said rotary plate fastener to define spring fingers with outward portions for pressing against the fan blade.

* * * * *